US007337912B1

(12) United States Patent
Hull

(10) Patent No.: US 7,337,912 B1
(45) Date of Patent: Mar. 4, 2008

(54) AUTOMATICALLY DEPLOYABLE BOOM EXTENSION AND METHOD OF DEPLOYING SAME

(75) Inventor: William E. Hull, Greencastle, PA (US)

(73) Assignee: Manitowoc Crane Companies, Inc., Reno, NV (US)

( * ) Notice: Subject to any disclaimer, the term of this patent is extended or adjusted under 35 U.S.C. 154(b) by 0 days.

(21) Appl. No.: 11/703,683

(22) Filed: Feb. 8, 2007

(51) Int. Cl.
*B66C 23/42* (2006.01)

(52) U.S. Cl. ..... 212/300; 212/168

(58) Field of Classification Search ..... 212/168, 212/300
See application file for complete search history.

(56) References Cited

U.S. PATENT DOCUMENTS

| | | | |
|---|---|---|---|
| 3,785,505 | A | 1/1974 | Keller, Jr. |
| 3,945,333 | A | 3/1976 | Fritsch et al. |
| 3,968,884 | A | 7/1976 | Johnson et al. |
| 4,045,923 | A | 9/1977 | Shanmugasundaram |
| 4,091,936 | A | 5/1978 | Wuerflein et al. |
| 4,141,455 | A | 2/1979 | Henderson et al. |
| 4,318,488 | A | 3/1982 | Rathi |
| 4,431,109 | A | 2/1984 | Behrendt et al. |
| 4,483,447 | A | 11/1984 | Bernabe, Jr. |
| 4,491,229 | A | 1/1985 | Behrendt et al. |
| 4,621,742 | A | 11/1986 | Rathi |
| 5,111,945 | A | 5/1992 | Hull et al. |
| 5,673,805 | A | 10/1997 | Chaffin |

FOREIGN PATENT DOCUMENTS

| | | | |
|---|---|---|---|
| JP | 2003-206094 | A * | 7/2003 |

* cited by examiner

*Primary Examiner*—Thomas J Brahan
(74) *Attorney, Agent, or Firm*—Birch, Stewart, Kolasch & Birch LLP

(57) ABSTRACT

A crane including a telescoping boom has a base boom member and an inner member slidably mounted in the base boom member with a first end projecting from the base boom member. The inner member includes first and second connector elements. A boom extension has a first end including first and second attachment elements. The boom extension also includes first and second spaced bracket assemblies and is shiftable between use and storage positions. A first support associated with the base boom member includes a holder for pivotably retaining the first bracket assembly and a second support has a rail projecting from the base section. A slider is slidably supported by the rail, and an actuator connected between the slider and the boom shifts the slider between a retracted position and an extended position relative to the base boom member. A method of deploying a boom extension is also disclosed.

16 Claims, 15 Drawing Sheets

AUTOMATICALLY DEPLOYABLE BOOM EXTENSION AND METHOD OF DEPLOYING SAME

FIELD OF THE INVENTION

The present invention is directed toward an automatically deployable boom extension and to a method of deploying same, and, more specifically, toward a boom having an actuator connected thereto for moving a portion of a boom extension away from the boom during a boom extension deployment and toward a method of controlling the actuator during the course of a boom extension deployment.

BACKGROUND OF THE INVENTION

To extend the reach of crane booms having telescopic boom sections, a side stowable jib or boom extension may be provided for connection to the nose assembly of the fly section or next adjacent boom section, as disclosed in U.S. Pat. Nos. 3,785,505, dated Jan. 15, 1974, and 4,483,447, dated Nov. 20, 1984. The entire contents of these patents are hereby incorporated by reference.

When moving the boom extension from a storage position on the side of the telescopic boom to a use position wherein the boom extension extends outwardly in alignment with the longitudinal axis of the boom, the boom extension is pivotally connected to one side of the nose assembly of the boom section and then swung around and connected to the other side of the nose assembly. The connections are made by a plurality of pins extending through aligned holes provided in the cooperating end portions of the boom extension and nose assembly of the fly section.

On relatively small cranes, holes on the boom extension can be aligned with holes on the boom by manually pulling one end of the boom extension away from the boom and pivoting the boom extension on an intermediate support until the openings on the extension come into alignment with the openings on the boom nose. Cranes such as the one disclosed in U.S. Pat. No. 3,785,505, for example, include a roller on the boom extension that is rolled up a short ramp to carry the boom extension onto a boom extension support on the boom. While this arrangement performs satisfactorily, if an operator inadvertently removes the safety retaining pin from the intermediate support, pulling the rear portion of the boom extension away from the boom could result in the entire boom extension detaching from the boom and severely injuring the operator. Additional safety devices therefore must generally be provided to minimize this problem.

Another approach to boom extension deployment has been developed for relatively small cranes. In such cranes, the rear portion of the boom extension slides toward and away from the boom on a slider mounted on a rail. The boom extension is retained on the slider by pins projecting in the direction of the front end of the boom. Therefore, even when the slider is in the extended position, the boom extension will not detach from the slider until it is moved in the direction toward the outward end of the boom, and the extension will not detach from the boom even if an operator accidentally removes the safety pin from the intermediate support before moving the rear portion of the boom. Even with relatively small cranes, however, it is difficult for an operator to move the heavy boom extension as required to ensure that the front end of the boom extension is aligned with openings on the boom. This arrangement has therefore not been widely adopted on small cranes and is impracticable for larger cranes having heavier boom extensions.

It would therefore be desirable to provide a boom extension that is easily shiftable from a storage position to a position wherein the boom extension can be connected to a boom regardless of the size of the boom extension and to provide a boom extension that will not readily detach from a boom.

SUMMARY OF THE INVENTION

These problems and others are addressed by the present invention, a first aspect of which comprises a crane that includes a telescoping boom having an outer boom member having a first end and an inner member slidably mounted in the outer boom member with a first end projecting from the outer boom member first end. The first end of the inner member includes a first connector element having an opening and a second connector element having an opening. The crane also includes a boom extension having a first end and a second end, the first end including first and second attachment elements each having an opening. The boom extension first side includes first and second spaced bracket assemblies. The boom extension is shiftable between a use position where the opening of the first attachment element is aligned with the opening of the first connector element and the opening of the second attachment element is aligned with the opening of the second connector element and a storage position where the boom extension overlies and is connected to first and second supports on the outer boom member and the second attachment element is spaced from the second connector element. The first support may be a holder for pivotably retaining the first bracket assembly and the second support may be a rail projecting from the outer boom member first side and a slider slidably supported by the rail. An actuator is connected between the slider and the boom for shifting the slider between a retracted position and an extended position relative to the outer boom member.

Another aspect of the invention comprises a method of deploying a boom extension on a telescoping crane boom that includes steps of providing a boom having an outer member having first and second supports and a telescoping inner member comprising a first end having first and second connector elements each having an opening where the second support may be a slider slidably mounted on a rail to be shiftable between a retracted and an extended position by an actuator. An aspect of the invention includes providing a boom extension having a first end including first and second attachment elements each having an opening, the boom extension having first and second bracket assemblies. The first bracket assembly is connected to the boom first support and the second bracket assembly is connected to the boom second support so that the first attachment element is spaced from the first connector element. The actuator is controlled to move the slider toward the extended position until the opening of a first attachment element is aligned with the opening of a first connector element. The first attachment element is connected to the first connector element. The boom extension is disconnected from the first and second supports by extending the inner member from the outer member, and the boom extension is pivoted about the boom extension first connector element until the opening of the second attachment element is aligned with the opening of the second connector element. Then the second attachment element is connected to the second connector element.

BRIEF DESCRIPTION OF THE DRAWINGS

These aspects and features of the invention and other will be better understood after a reading of the following detailed description together with the attached drawings wherein.

DETAILED DESCRIPTION

Figure 1:
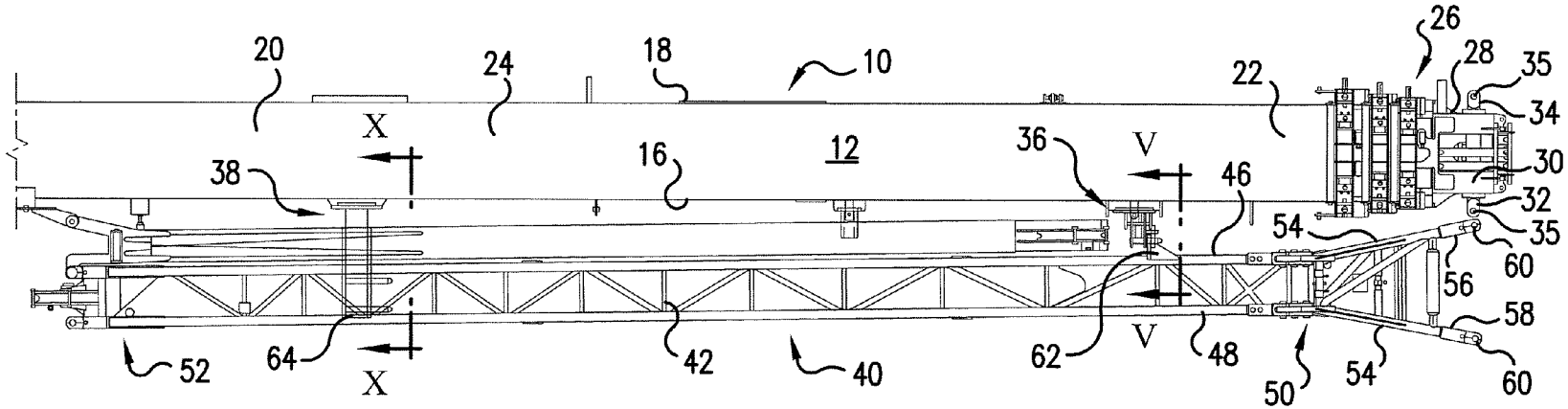
FIG. 1 is a top plan view of a telescoping boom have having front and rear supports for holding a boom extension and a boom extension mounted on the front and rear supports in a stored position.

Referring now to the drawings, which are for purposes of illustrating preferred embodiments of the invention only and not for the purpose of limiting same, FIGS. 1-4 and 17 illustrate a boom 10 having a top 12, a bottom 14 a first side 16, a second side 18, a rear end 20 and a front end 22. Boom 10 further comprises a base section 24 and a plurality of telescoping sections 26 projecting from front end 22. The telescoping end of the boom may be referred to hereinafter as the front of the boom and the opposite end of the boom may be referred to as the rear or base of the boom. These terms will also be used to describe the boom extension mounted on the side of the boom; that is the "front" of the boom extension is the portion closest to the telescoping portion of the boom when the extension is mounted on the boom even though the front and rear portions of the boom extension will change position as the boom extension swings into its use position (see, e.g. FIG. 17). Relative directional terms such as "above" and "below" may also be used to refer to the boom in its normal operating position with the top 12 of boom 10 facing upwardly and bottom 14 facing the ground.

The front-most telescoping section 28 has a terminal end 30 having a first pair of upper and lower connector elements 32 on the first side 16 of boom 10 and a second pair of upper and lower connector elements 34 on second side 18 of boom 10. First side 16 of boom 10 further includes a front boom extension support 36 and a rear boom extension support 38 for supporting a boom extension along the boom 10 in a storage position when the boom extension is not needed.

Boom extension 40 is also illustrated in FIGS. 1-4 and includes a top 42, a bottom 44, a first side 46, a second side 48, a front end 50 and a rear end 52. Front end 50 may be considered the base of the extension, to be mounted on the telescopic boom, as described below. Front end or base 50 includes diverging leg portions 54 each terminating in an attachment element. Leg portions 54 on first side 46 of extension 40 end in a first pair of attachment elements 56, and leg portions 54 on second side 48 of extension 40 end in a second pair of attachment elements 58. Each of the first and second pairs of attachment elements 56, 58 includes a hole or opening 60. A front connector assembly 62 is mounted on first side 46 of boom extension 40 and is adapted to engage the front boom extension support 36 on boom 10, and a rear connector assembly 64 is provided on first side 46 of boom extension 40 and is adapted to engage the rear boom extension support 38 on boom 10. Rear end 52 comprises the top of the extension when it is mounted on the telescopic boom.

Front boom extension support 36 and front extension connector assembly 62 are illustrated in greater detail in FIGS. 5-9. Front boom extension 36 comprises a main plate 70 having a plurality of slots 72 connected to first side 16 of boom 10 by support 71 welded to first side 16 of boom 10. Bolts 74 or similar fasteners extend through slots 72 in main plate 70 to connect main plate 70 to support 71. This arrangement allows the position of main plate 70 to be adjusted relative to support 71 and boom 10 as necessary to ensure proper operation of the boom extension as described hereinafter.

A pair of upper spacing plates 76 extend perpendicularly from an upper portion of main plate 70, a lower spacing plate 78 extends perpendicularly from a lower portion of main plate 70, a pair of upper adjustable plates 80 is connected to upper spacing plates 76, and a lower adjustable plate 82 is connected to lower spacing plate 78 in each case using bolts or similar fasteners 84. Fasteners 84 extend through aligned openings in the spacing plates 76, 78 and adjustable plates 82, 84 and allow positions of the adjustable plates 80, 82 relative to first side 16 of boom 10 to be adjusted as necessary to ensure proper operation of the boom extension as described hereinafter. An alignment pin 86 is mounted on upper adjustable plates 80, extends in the direction of front end 22 of boom 10, and a has a generally circular cross section. An alignment tab 88 having an opening 89 projects from lower adjustable plate 82 also in the direction of front end 22 of boom 10.

Front boom extension connector assembly 62 comprises an upper bracket 90 projecting normally from first side 46 of boom extension 40 which upper bracket 90 includes an alignment opening 92 configured to slidably receive alignment pin 86 on upper adjustable plate 80. Alignment opening 92 is sufficiently larger in diameter than the diameter of alignment pin 86 to allow the boom extension 40 to pivot on pin 90 relative to boom 10 by at least several degrees for reasons described herein.

Front boom extension connector assembly 62 also includes a lower bracket 94 projecting normally from first side 46 of boom extension 40 and includes an alignment slot 96 somewhat larger than alignment tab 88 of lower adjustable plate 82 configured to receive alignment tab 88. A locking pin 98 passes through opening 89 in alignment tab 88 to limit longitudinal movement of boom extension 40 relative to boom 10 while allowing the boom extension 40 to pivot by at least several degrees.

Figure 10:
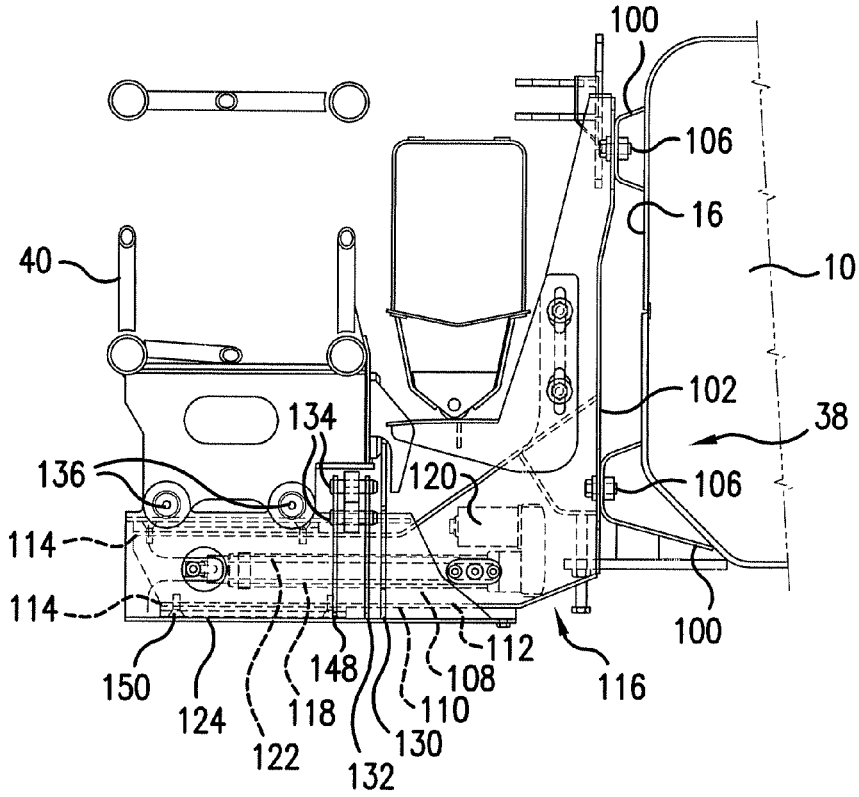
FIG. 10 is an elevational view, partly in section, of the rear boom 20 extension support when the extension is positioned as in FIG. 1, taken in the direction of arrows X-X in FIG. 1.
Figure 11:
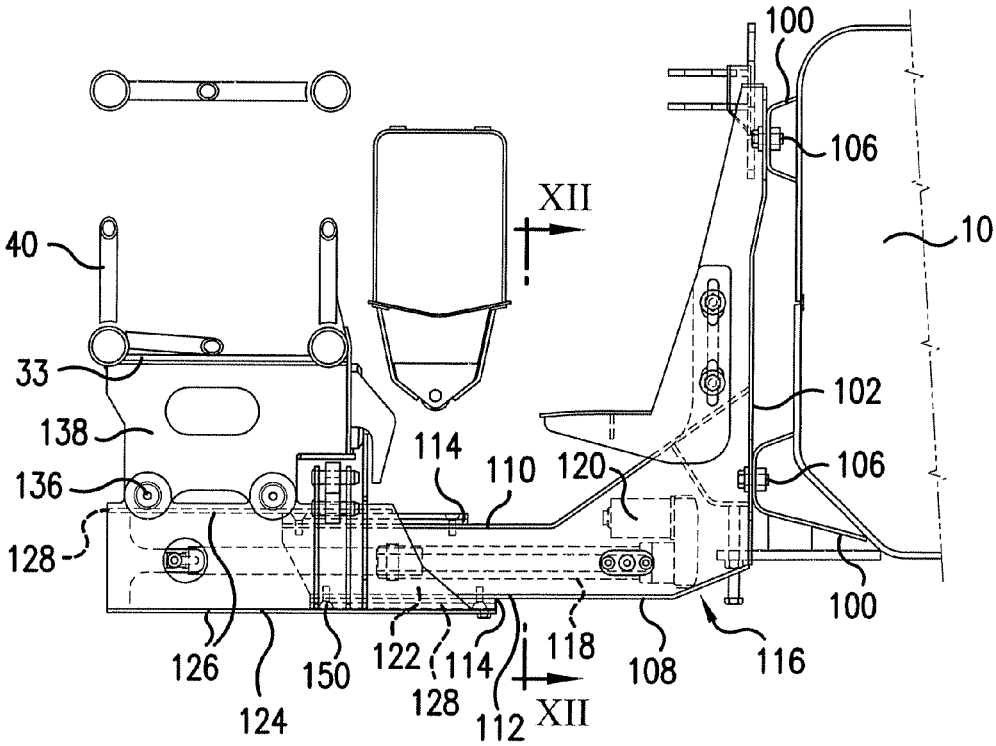
FIG. 11 is an elevational view, partly in section, of the rear boom extension support when the extension is positioned as in FIG. 2, taken in the direction of arrows XI-XI in FIG. 2.
Figure 12:
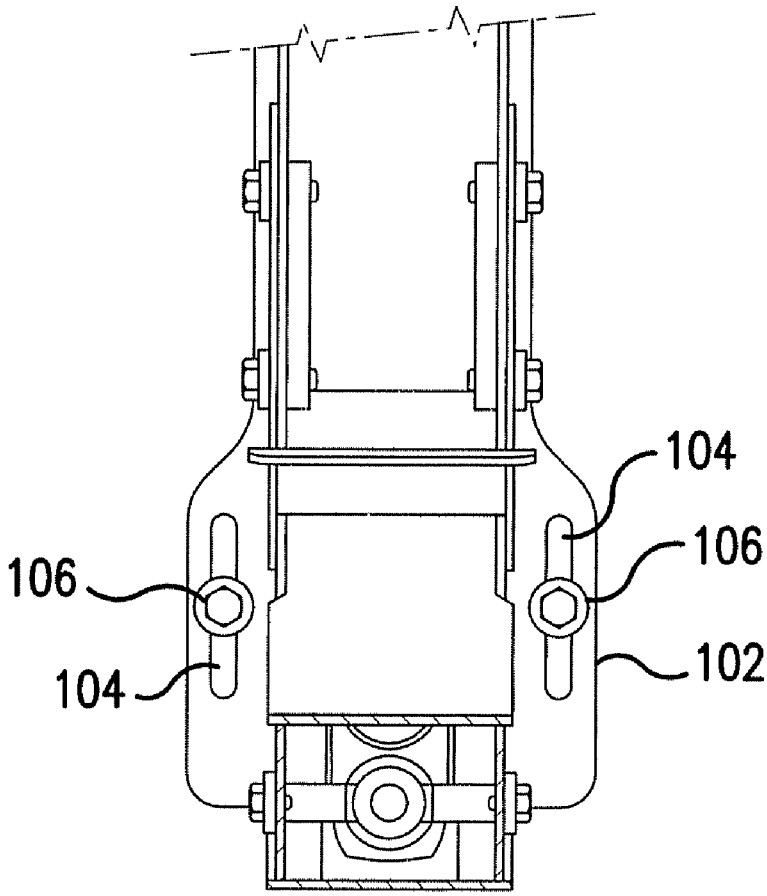
FIG. 12 is an elevational view taken in the direction of line XII-XII in FIG. 11.

Rear boom extension support 38 and rear boom extension connector assembly 64 are illustrated in greater detail in FIGS. 10-15. With reference to FIG. 10, rear boom extension support 38 comprises upper and lower supports 100 welded to first side 16 of boom 10 and a support arm 102 having slots 104 connected to upper and lower supports 100 by bolts 106. The bolt and slot arrangement allows the position of support arm 102 and to be adjusted as necessary. A rail 108 extends from support arm 102 and includes an upper surface 110 generally parallel to a lower surface 112, the upper and lower surfaces being provided with wear pads 114 formed of a dense, low-friction plastic.

An electromechanical actuator 116 having a housing 118, a motor 120 and a screw 122 is mounted to support arm 102, and motor 120 is configured to drive screw 122. A slider 124 having parallel upper and lower surfaces 126 each including a wear pad 128 slidingly engages rail 108 with the wear pads 128 of the slider in contact with the wear pads 114 of the rail 108. Screw 122 of electromechanical actuator 116 connects to slider 124 to move the slider 124 from a first, retracted, position, illustrated in FIG. 10 to a second, extended position, illustrated in FIG. 11, relative to rail 108 and boom 10. Other types of actuators, including hydraulic actuators, could be used without departing from the scope of this invention.

An alignment wall 130 projects from slider 124 in the direction of front end 50 of boom extension 40, and first and second support walls 132 project from slider 124 parallel to alignment wall 130. First and second rollers 134 are rotatably mounted between first and second support walls 132, and the roller closest to front end 50 of boom extension 40 is mounted at a lower elevation than the other roller 134. First and second alignment pins 136 project from slider 124 in the direction of the front 50 of the boom extension 40.

Figure 16:
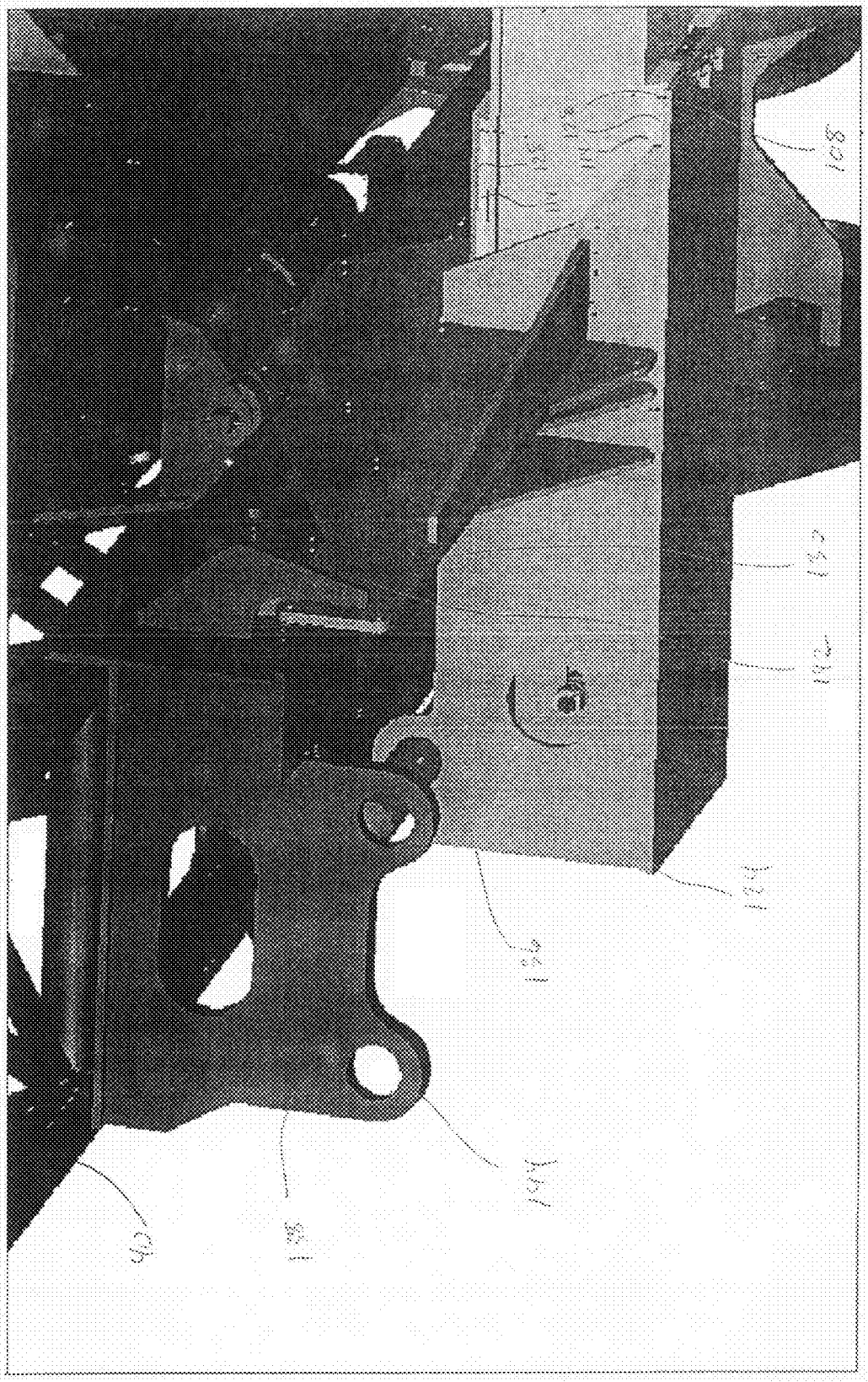
FIG. 16 is a second perspective view of the rear boom extension support of FIG. 1.

Boom extension rear connector assembly 64 comprises a frame 138 depending from bottom 33 of boom extension 40 which frame includes a ramp wall 140, an alignment finger 142 illustrated in FIG. 16, and first and second alignment openings 144 configured to receive alignment pins 136 on slider 124.

Figure 4:
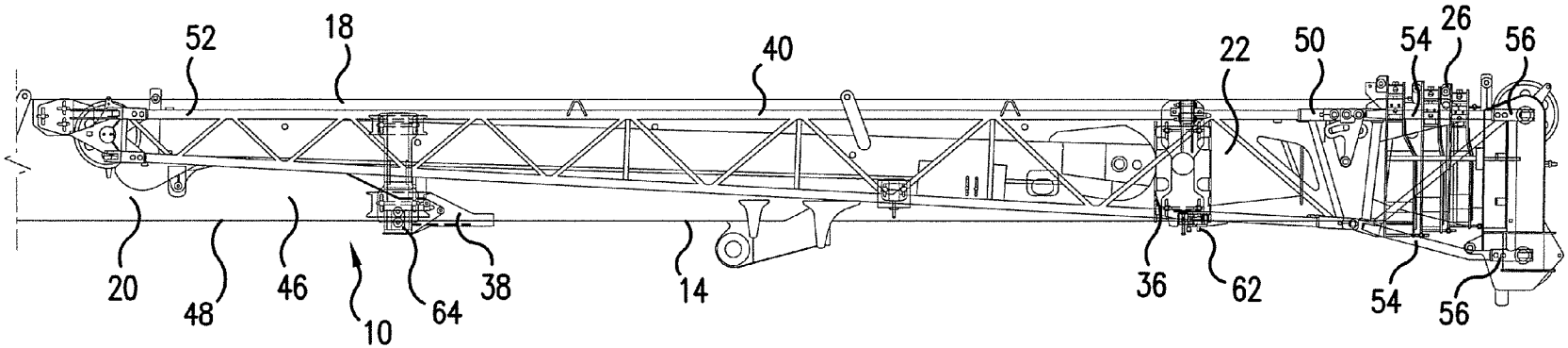
FIG. 4 is a side elevational view of the boom extension and boom of FIG. 1.
Figure 5:
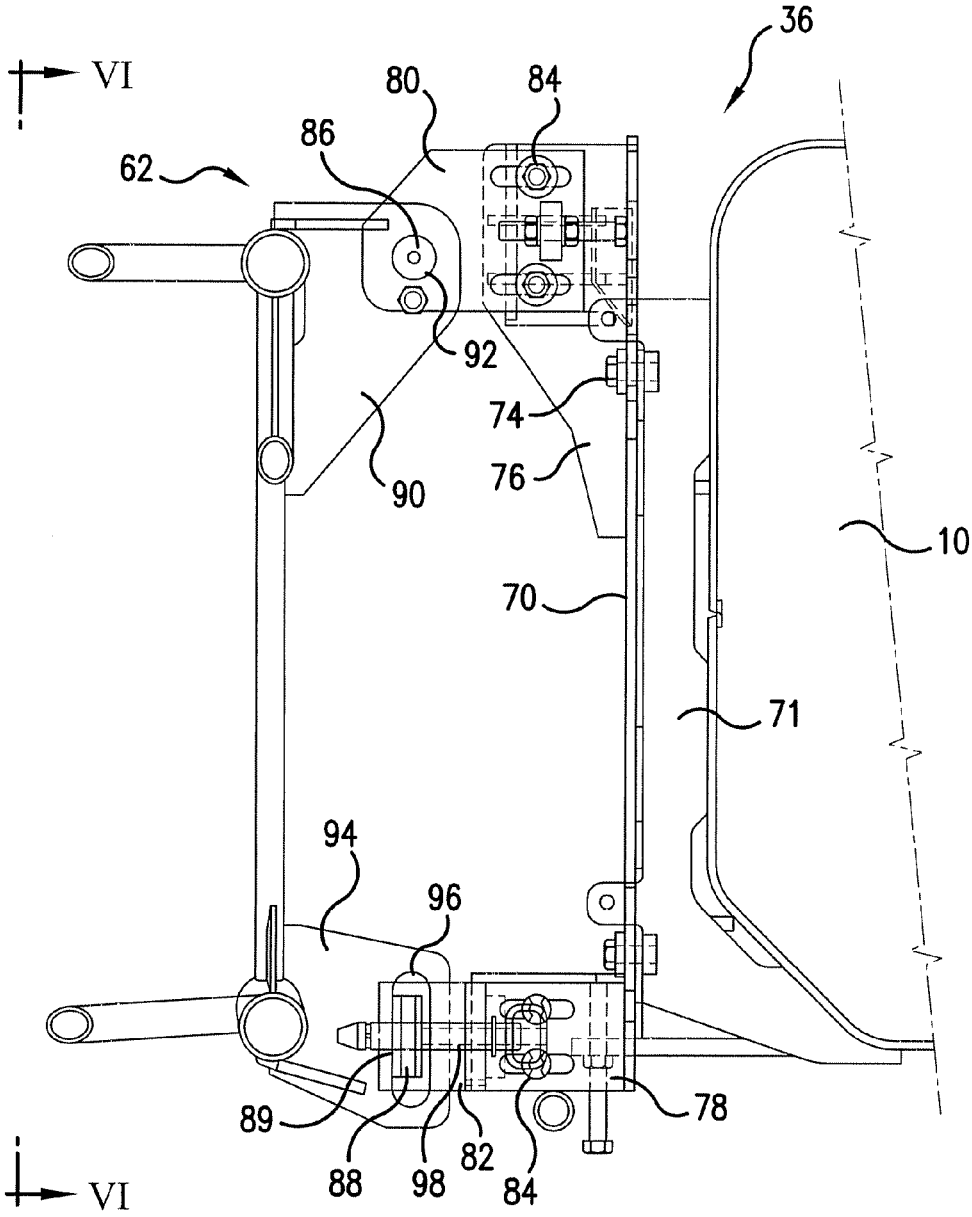
FIG. 5 is an elevational view of the front boom extension support taken in the direction of arrows V-V of FIG. 1.
Figure 6:
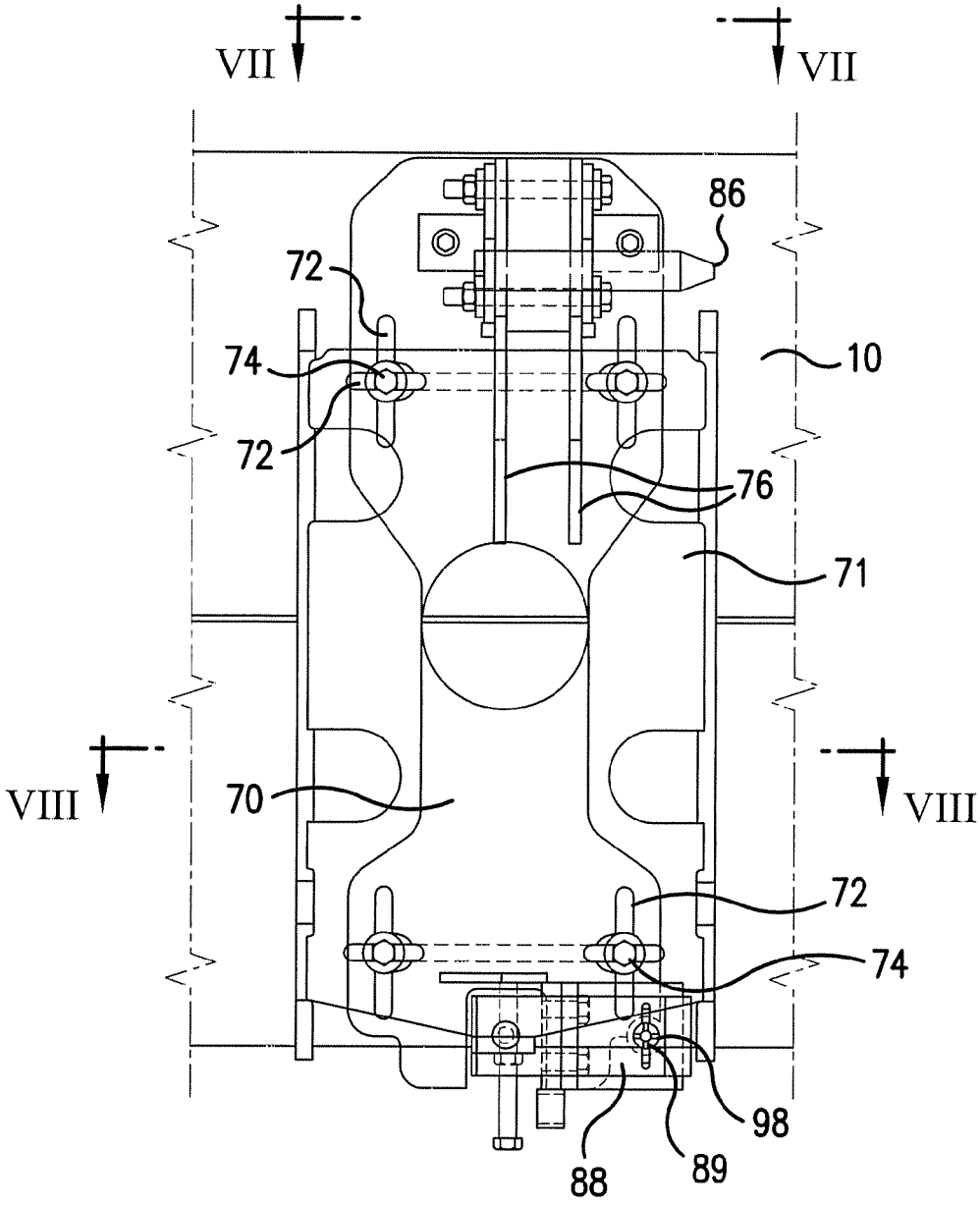
FIG. 6 is an elevational view of the front boom extension support taken in the direction of arrows VI-VI in FIG. 5.
Figure 7:
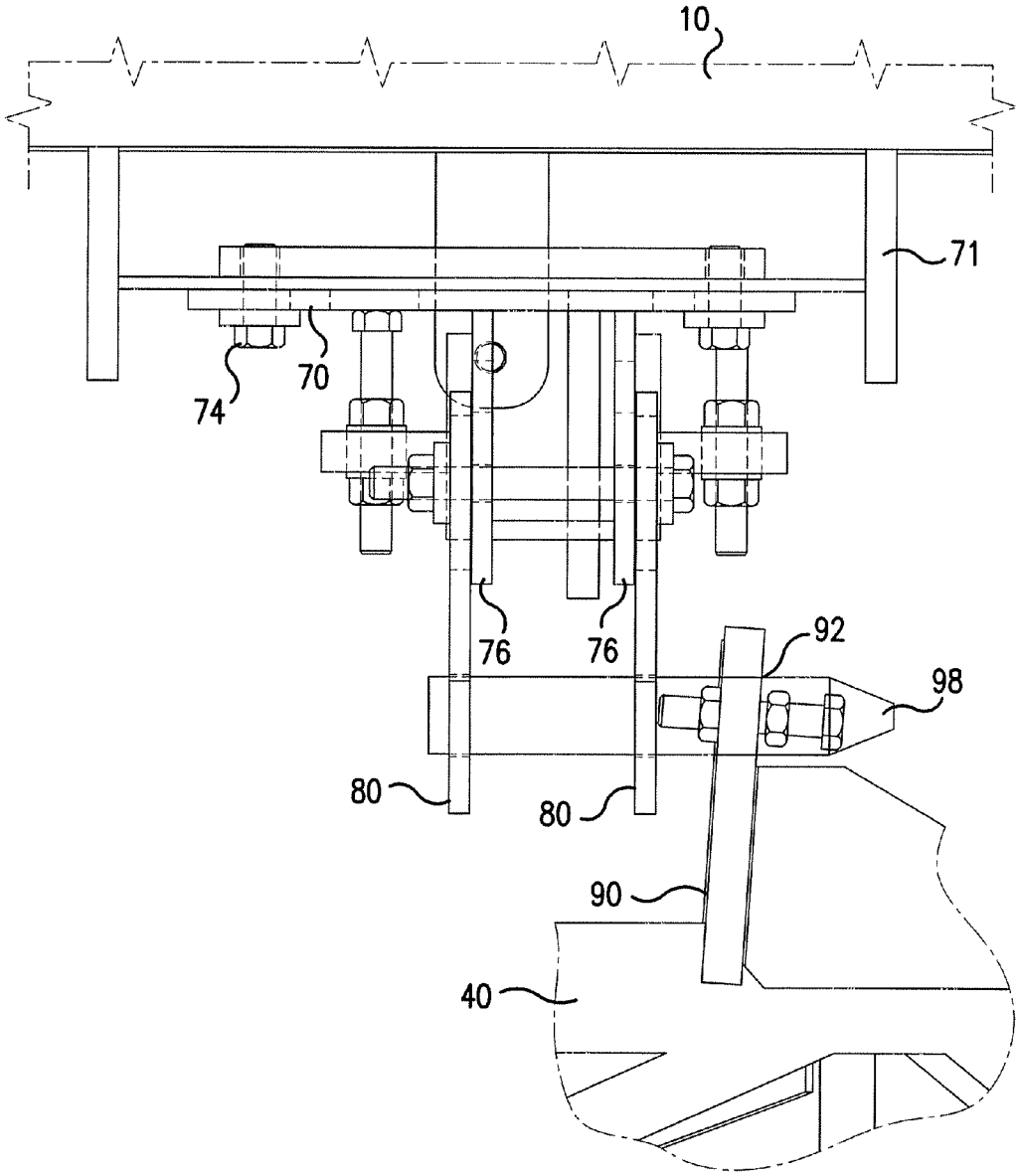
FIG. 7 is a plan view of a first portion of the front boom extension support taken in the direction of arrows VII-VII in FIG. 6.
Figure 8:
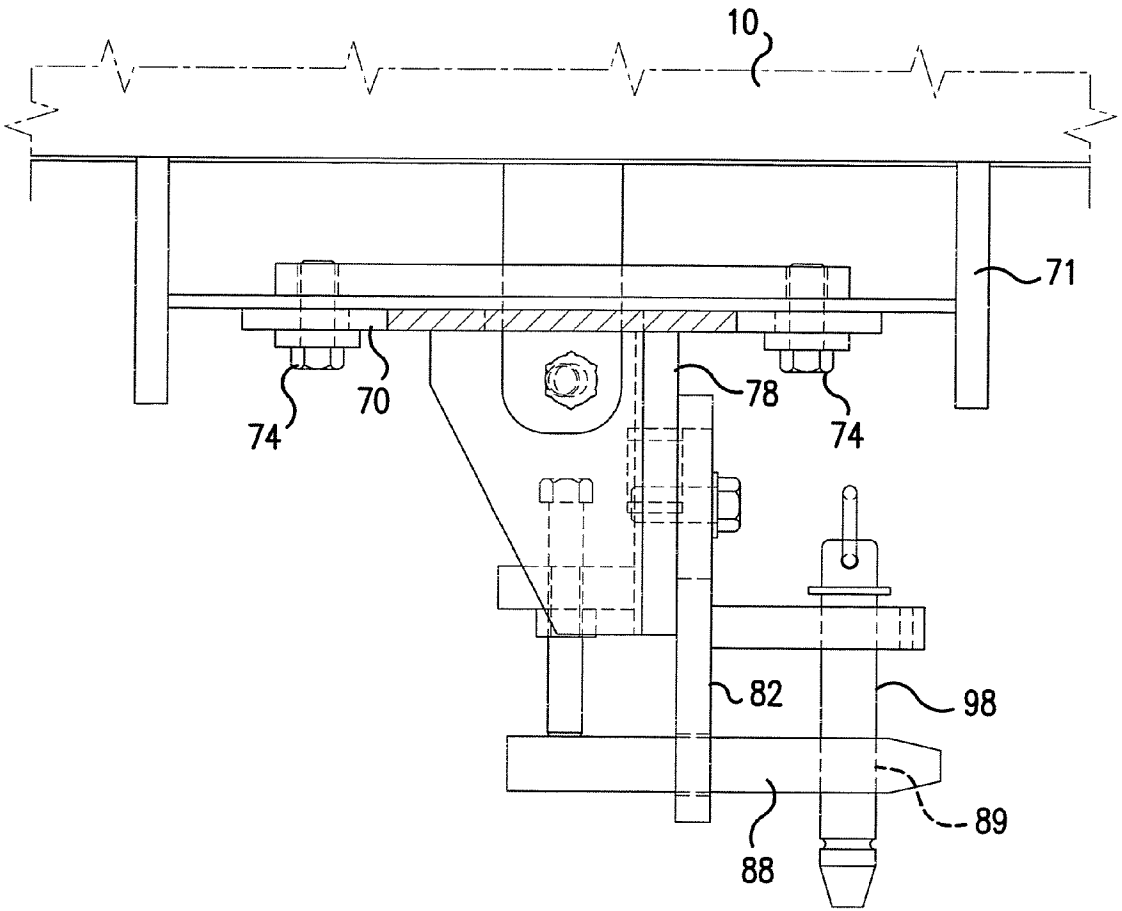
FIG. 8 is a plan view of a second portion of the front boom extension support taken in the direction of arrows VIII-VIII in FIG. 6.
Figure 9:
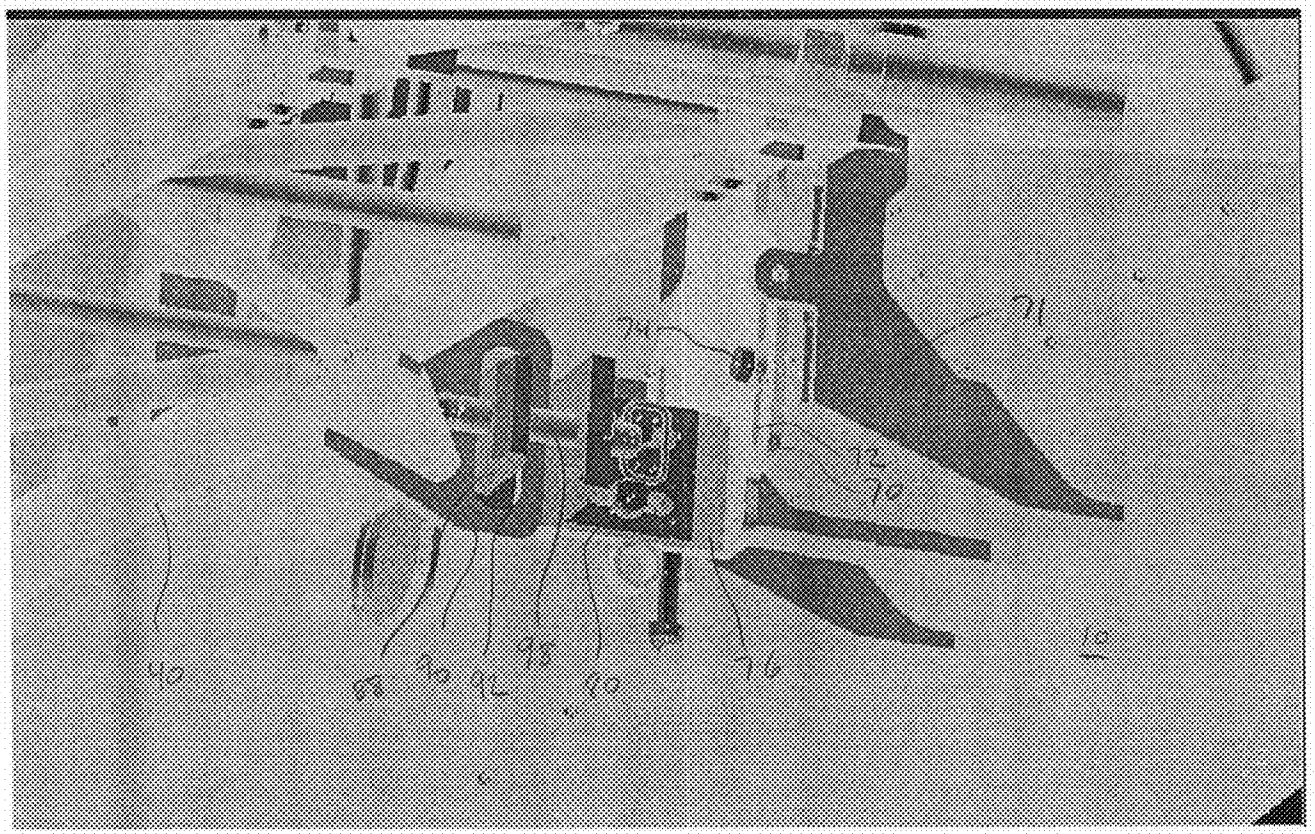
FIG. 9 is a perspective view of the second portion of the front boom extension support.

The deployment of boom extension 40 is discussed below. Boom extension 40 is mounted in a storage and transport position against first side 16 of boom 10, as illustrated in FIGS. 1 and 4. Boom 10 can be used in a traditional manner with boom extension 40 safely stored on the side thereof. As illustrated in FIG. 5, in this configuration, alignment pin 86 of front boom extension support 36 projects through alignment opening 92 on the upper bracket 90 of front boom connector assembly 62, and alignment tab 88 of boom extension support 36 projects through alignment slot 96 on lower bracket 94 of boom connector assembly 62 while locking pin 98 passes through opening 89 in alignment tab 88. This arrangement substantially prevents boom extension 40 from separating from boom 10.

Figure 13:
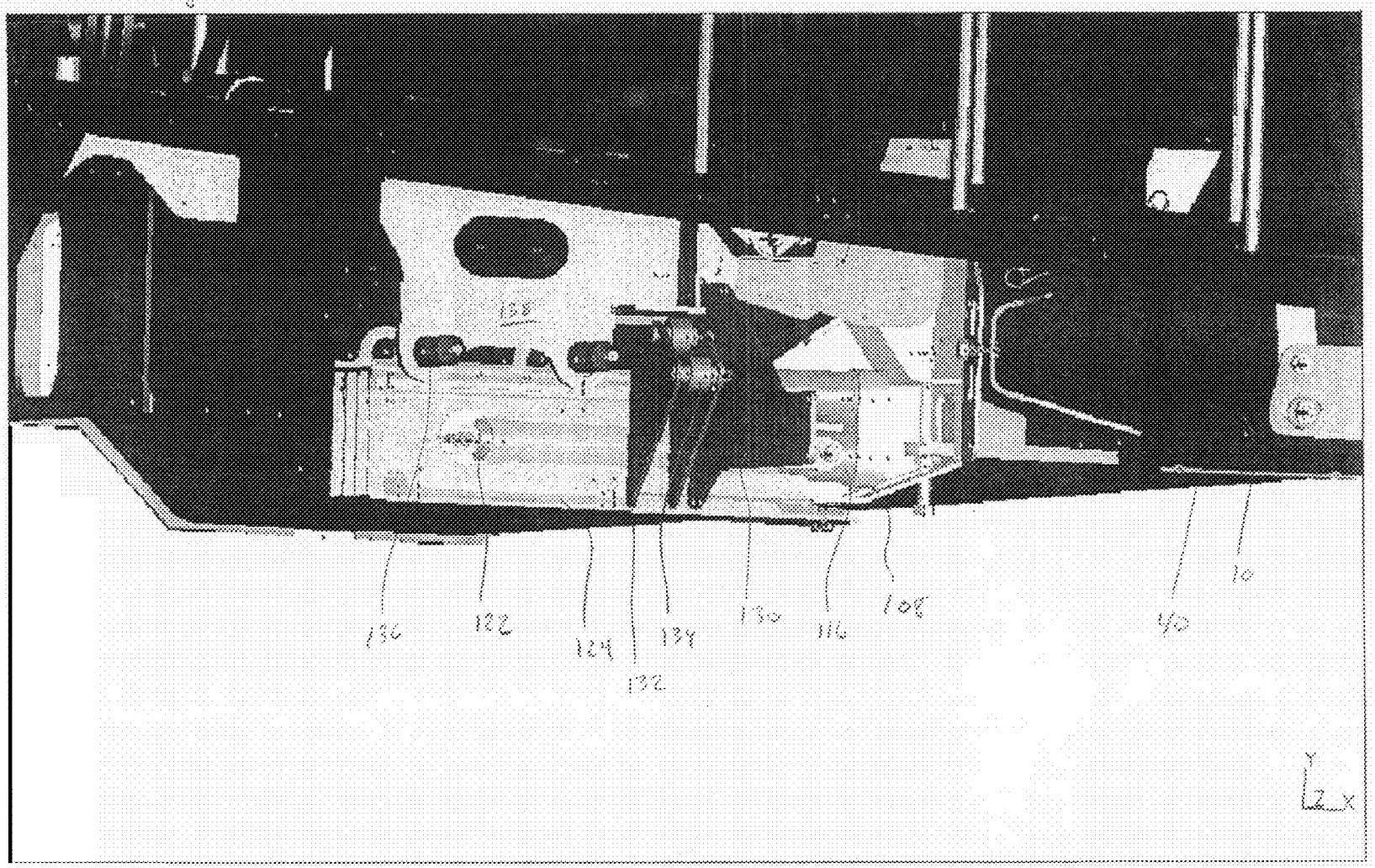
FIG. 13 is a first perspective view of the rear boom extension support when the extension is positioned as in FIG. 1.
Figure 14:
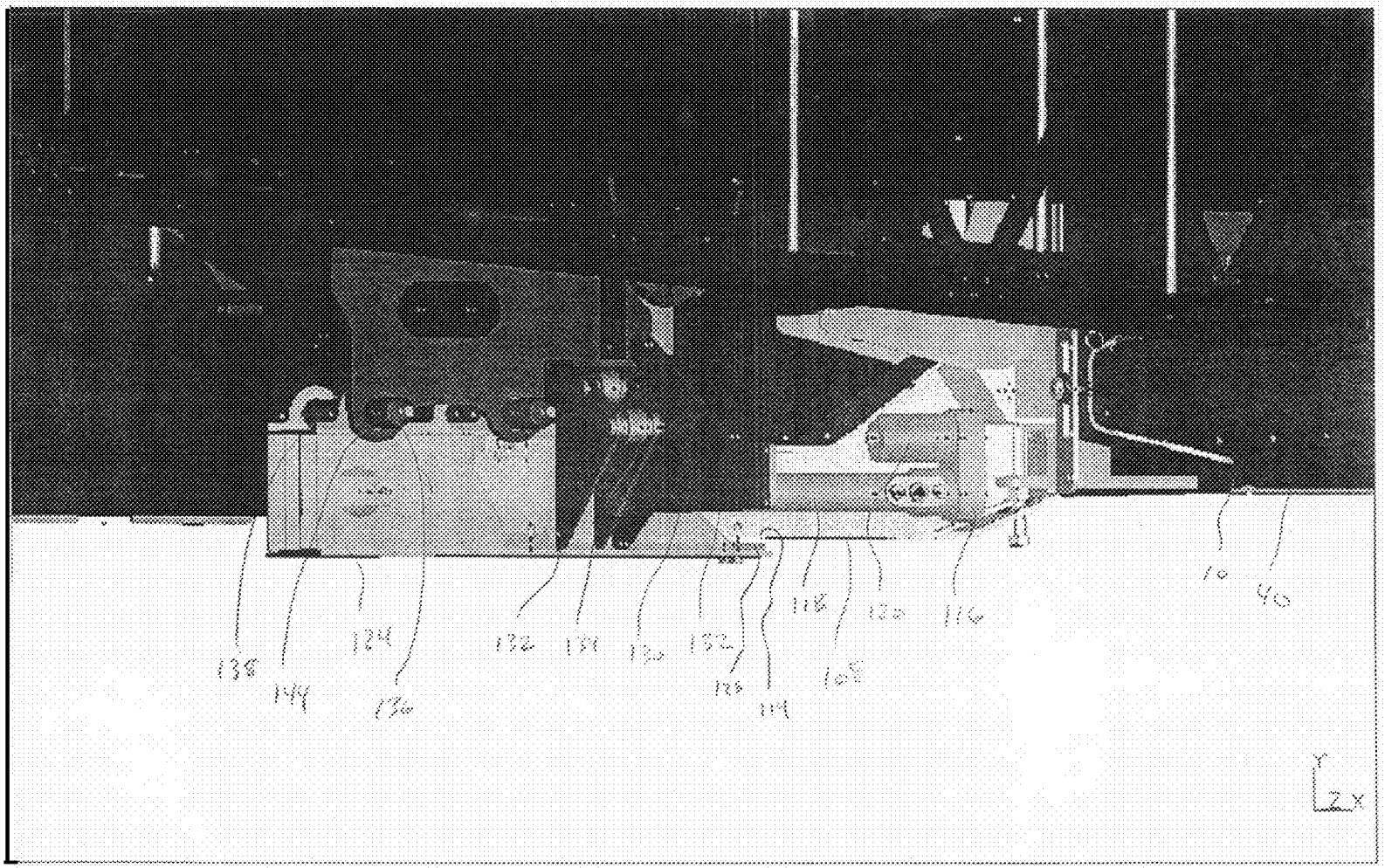
FIG. 14 is a perspective view of the rear boom extension support 30 when the extension is positioned as in FIG. 2.
Figure 15:
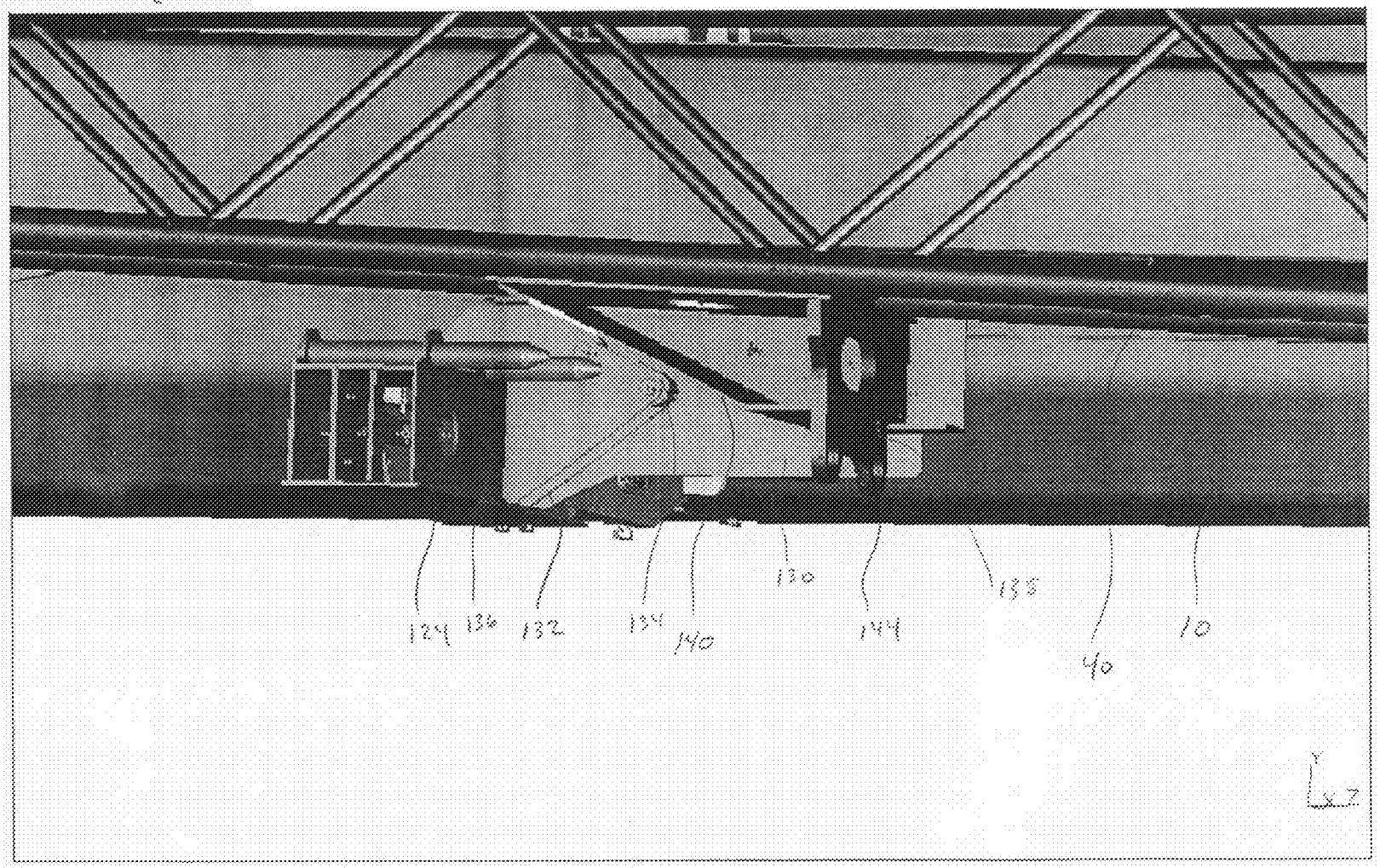
FIG. 15 is a perspective view of the rear boom extension support when the extension is positioned as in FIG. 3.

Likewise, with reference to FIG. 13, alignment pins 136 on slider 124 project through alignment openings 144 on boom extension rear connector assembly 64 to secure the boom extension 40 to the slider 124, and linear actuator 116 is powered down to retain slider 124 in a retracted position on rail 108 relative to boom 10. In this configuration, as will be appreciated from FIG. 1, the first pair of attachment elements 56 on first side 46 of boom extension 40 are spaced from the first pair of connector elements 32 on the first side 16 of boom 10.

Figure 17:
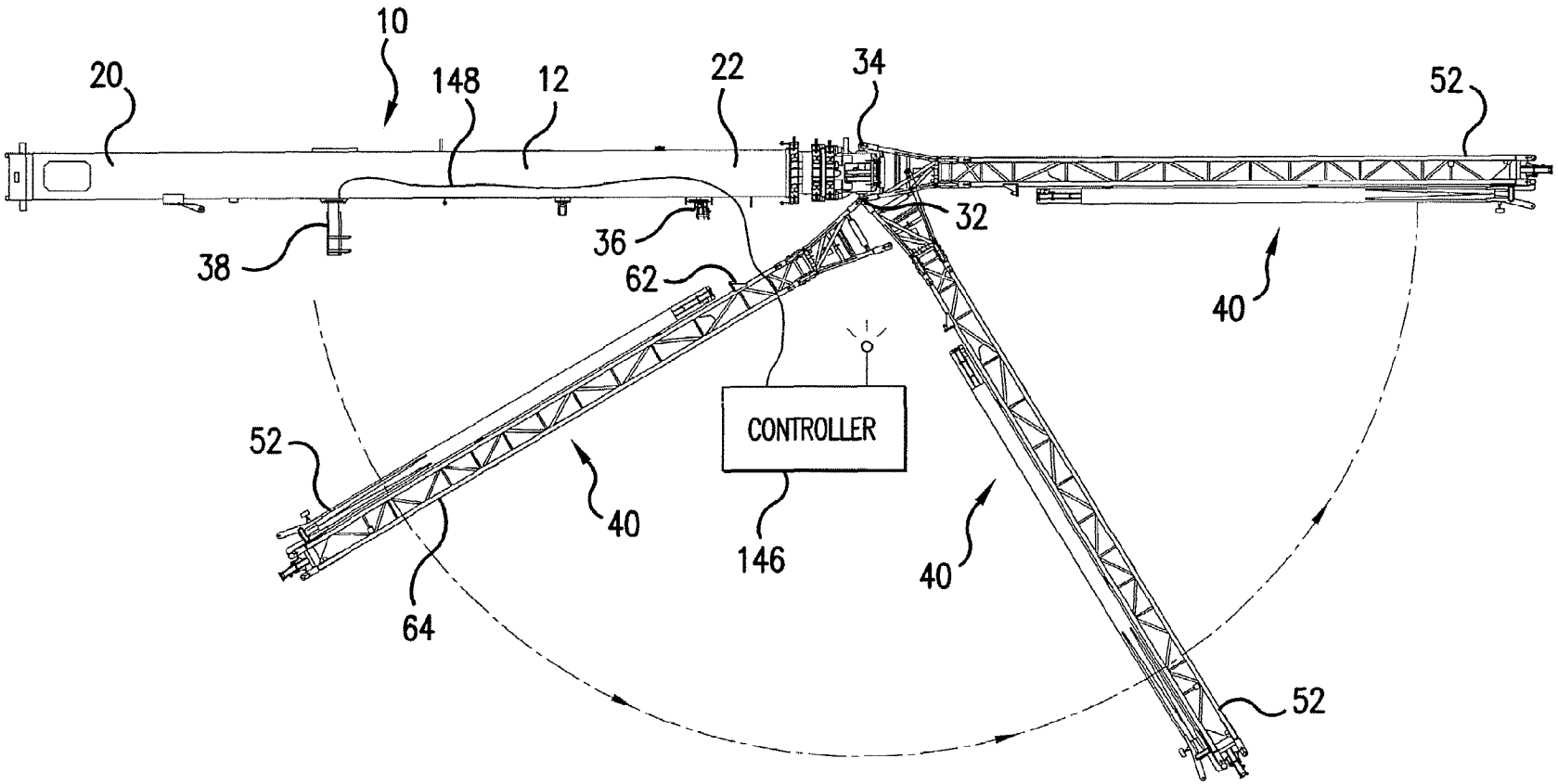
FIG. 17 is a top plan view illustrating the boom extension swinging into a deployed position.

To deploy boom extension 40 to a use position mounted on and aligned with boom 10 as illustrated in FIG. 17, linear actuator 116 is actuated by controller 146, illustrated in FIG. 17. The controller is preferably mounted near the front end 22 of boom 10 and may be connected to linear actuator motor 120 by a wire 148 or using an RF transmitter if the linear actuator 116 is suitably equipped with an RF receiver. Linear actuator motor 118 drives screw 122 to move slider 124 and therefore boom extension 40 away from boom 10 toward the position illustrated in FIG. 2.

Figure 2:
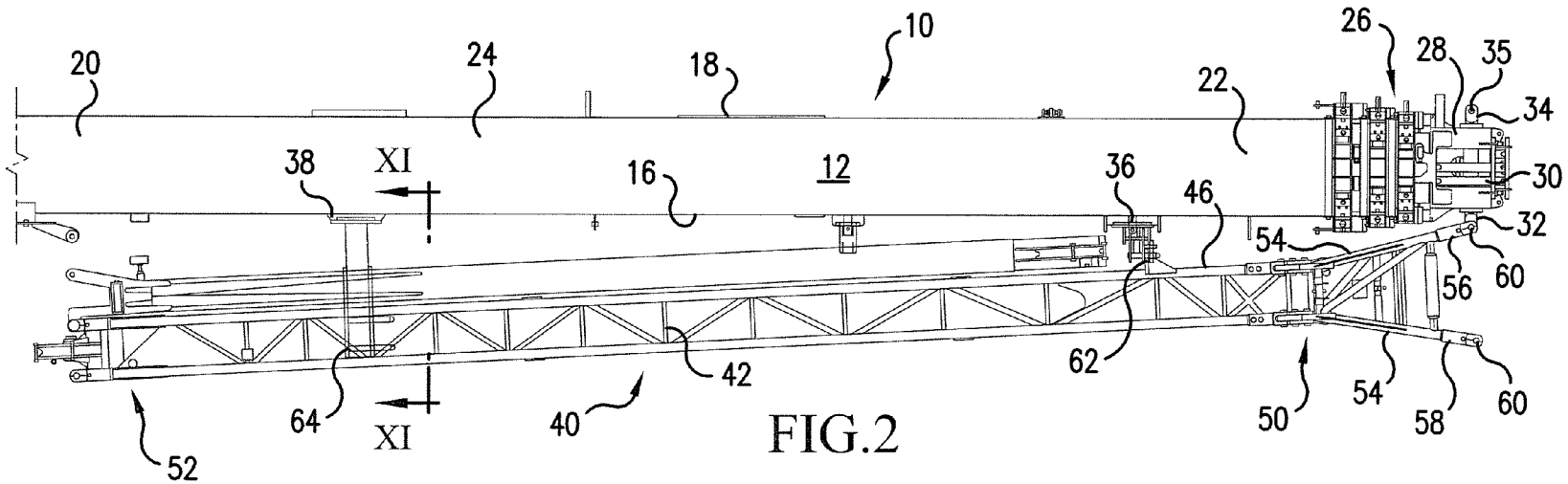
FIG. 2 is a top plan view of the telescoping boom and boom extension of FIG. 1 with a rear end of the boom extension shifted away from the boom.
Figure 3:
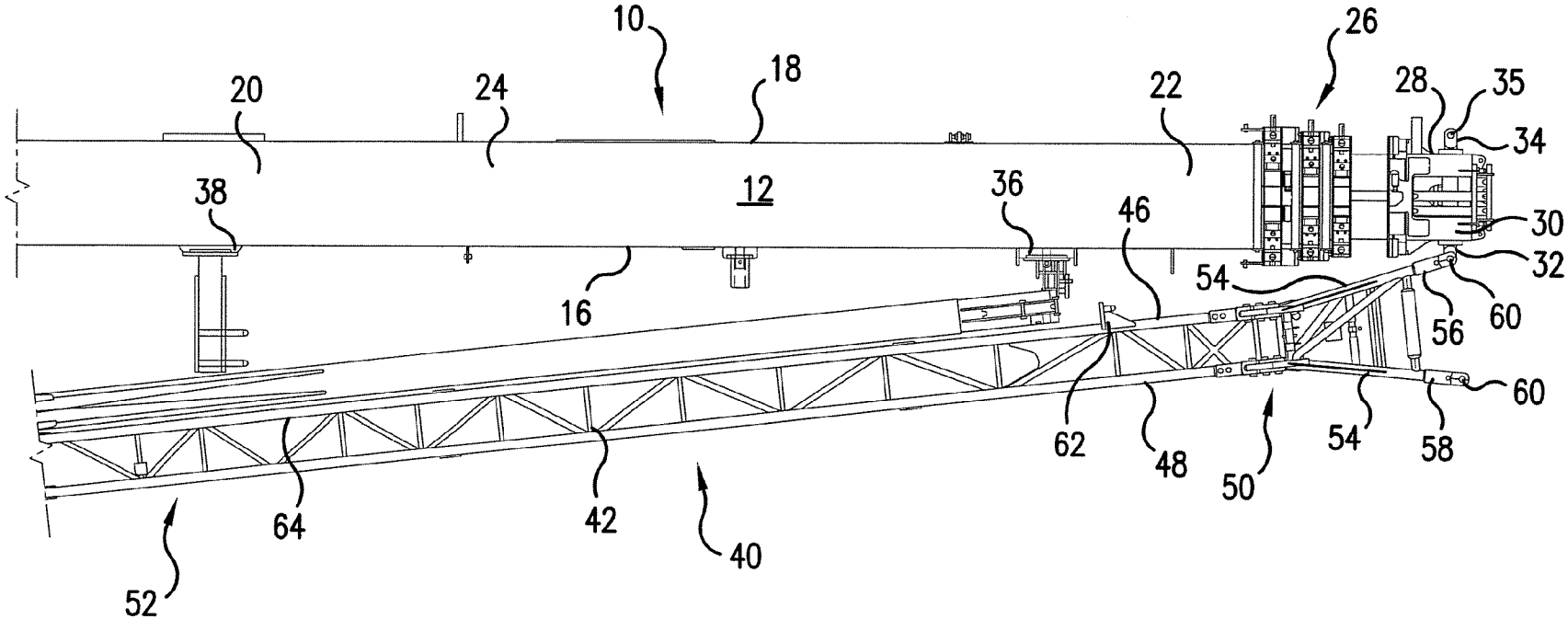
FIG. 3 is a top plan view of the boom extension and boom of FIG. 2 with the telescopic boom partially extended and the boom extension shifted longitudinally from the position illustrated in FIG. 2.

Slider 124 is driven away from boom 10 until the holes 60 in the first pair of attachment elements 56 on boom extension 40 are aligned with the holes 35 on the first pair of connector elements 32 of boom 10 as illustrated in FIG. 2. Controller 146 is preferably positioned close enough to connector elements 32 to enable an operator to observe the movement of the first pair of attachment elements 56 relative to the first connector elements 32 and turn off the linear actuator when all holes are aligned. Alternately, a stop 150 may limit the outward movement of slider 124 relative to rail 108 and be positioned such that the openings 35 in the first pair of connector elements 32 are aligned with the openings 60 in the first pair of attachment elements 56 when the motion of the slider 124 is arrested by the stop. Even when the stop is not used to align the holes 35 in the connection elements 32 with the holes 60 in the attachment elements 56, a stop 150 is still preferably provided to prevent slider 124 from disengaging from rail 108. When the holes in the connector elements 32 are aligned with the openings 60 in the attachment elements 56, an operator inserts pins (not illustrated) through the first pair of aligned openings to secure a first portion of the boom extension 40 to boom 10.

In this configuration, boom extension 40 is connected to boom 10 at three points: at first pair of connector elements 32, at front connector assembly 62 and at rear connector assembly 64. At this time, an operator removes locking pin 98 from alignment tab 88 and actuates a boom controller (not shown) to extend front-most telescoping section 28 of the boom from the boom base section 24 a small distance such as a foot or two to move the boom extension 40 into the position illustrated in FIG. 3. In this configuration, boom extension 40 is slid longitudinally off alignment pin 86 and alignment tab 88 of front boom extension support 32 and off alignment pins 136 of rear boom extension support 34. Once free of the boom extension supports, and with the help of an operator who pushes the boom extension 40 or raises or lowers the front end 22 of boom 10 in a well known manner, boom extension 40 is caused to swing through an arc as illustrated in FIG. 17 until the holes 60 in the second pair of attachment elements 56 align with the holes 35 in the second pair of connection elements 34, at which time additional pins (not shown) are inserted through the aligned openings to secure the boom extension 40 to the boom 10. After this assembly, the boom 10 together with boom extension 40 are operated in a conventional manner.

To stow boom extension 40, the above steps are substantially reversed. Pins (not illustrated) are removed from second connector elements 34 freeing the second side 48 of boom extension 40 from the boom, and the operator pushes the boom extension (or manipulates the position of the boom) to swing boom extension 40 through an arc until it is more or less aligned with the boom 10 in the configuration illustrated in FIG. 3. While maneuvering boom extension 40 into this position, front-most telescoping portion 28 of boom 10 is not fully retracted. When the boom extension 40 is adjacent the side of boom 10, in the configuration of FIG. 3, front-most telescoping portion 28 is retracted into boom housing 24 causing ramp wall 140 on rear connector assembly 64 (FIG. 15) to engage rollers 134 and guide alignment openings 144 toward alignment pins 136 of rear boom extension support 34. At the same time, alignment finger 142 overlaps alignment wall 130 (FIG. 16) to further guide and secure the boom extension 40 to the boom 10. Also the alignment pin 86 and alignment tab 88 of front boom extension support 36 engage the alignment opening 92 in bracket 90 and the alignment slot 96 in lower bracket 94. At this time an operator installs locking pin 98 into alignment tab 88. Linear actuator 116 is then operated to slide slider 124 on rail 108 toward boom 10 to pull boom extension 40 back into the storage position of FIG. 1.

With the above described system, even a large boom extension can readily be deployed by a sole operator while reducing the possibility of accidentally disconnecting a boom extension from the boom and injuring an operator or other property. The sole operator can also observe the position of the boom extension relative to the boom to align the openings without repeatedly walking back to the rear end of the boom and making further adjustments. Thus, when normal wear on the boom causes changes in the relative positions of elements of the boom and boom extension, the operator can correct for such wear by visual observation and use of the remote controller. The linear actuator further serves as a safety interlock and will substantially prevent the rear portion of the boom extension from being pulled away from the boom unless the actuator is used.

The present invention has been described herein in terms of an illustrated preferred embodiment. Various modifications and additions to this embodiment will become apparent to those skilled in the relevant arts upon a reading of the foregoing disclosure. It is intended that all such modifications and additions comprise a part of the present invention to the extent they come within the scope of the several claims appended hereto.

I claim:

1. A crane comprising:

a telescoping boom comprising a base boom member and an inner telescopic member slidably mounted in said base boom member and having a first end projecting from said base boom member, said first end of said inner member including a first connector element at a first side thereof and a second connector element at a second side thereof;

a boom extension having a first end and a second end, said boom extension first end including a first attachment element at a first side thereof and a second attachment element at a second side thereof, said boom extension further including first and second spaced bracket assemblies, said first bracket assembly being located between said second bracket assembly and said boom extension first end;

said boom extension being shiftable between a use position wherein said first attachment element is connected to the opening of said first connector element and said second attachment element is connected to said second connector element and a storage position wherein said boom extension is connected to first and second supports on said base boom member;

said first support comprising a holder for pivotably retaining said first bracket assembly;

said second support comprising a rail projecting from said base boom section and a slider slidably supported by said rail; and an actuator connected between said slider and said boom for shifting said slider between a retracted position and an extended position relative to said base boom member.

2. The crane of claim 1 wherein said rail comprises a planar upper surface and said slider comprises a planar lower surface slidably engaging said rail upper surface.

3. The crane of claim 1 wherein said rail includes a first wear plate mounted on a first rail surface and said slider includes a second wear plate mounted on a first slider surface facing said rail first surface, said first wear plate contacting said first wear plate when said slider is between said retracted position and said extended position.

4. The crane of claim 3 wherein said first wear plate substantially overlies said second wear plate when said slider is in said retracted position.

5. The crane of claim 1 wherein said actuator comprises an electromechanical actuator.

6. The crane of claim 1 wherein said actuator comprises a linear actuator.

7. The crane of claim 1 wherein said actuator comprises an electromechanical screw drive.

8. The crane of claim 1 including a controller in communication with said actuator for remotely controlling said actuator.

9. The crane of claim 8 wherein said controller is positioned adjacent to the boom extension first end with said boom extension in the storage position.

10. The crane of claim 8 wherein said controller comprises an radio-frequency transmitter for sending control signals to said actuator.

11. The crane of claim 8 wherein said controller is connected to said actuator by a wire, said wire extending from said actuator a distance sufficient to position said controller adjacent said first connector element.

12. The crane of claim 1 wherein said first connector element is aligned with said first attachment element when said slider is in a position between the retracted position and the extended position.

13. The crane of claim 1 wherein said first connector element is aligned with said first attachment element when said slider is in said extended position.

14. A method of deploying a boom extension on a telescoping crane boom comprising the steps of:

providing a boom having a base boom member comprising first and second supports, and a telescoping inner member comprising a first end having first and second connector elements, the second support comprising a slider slidably mounted on a rail and shiftable between a retracted and an extended position by an actuator;

providing a boom extension having a first end including a first attachment element and a second attachment element and a second end, and first and second bracket assemblies between the first and second boom extension ends;

connecting the first bracket assembly to the boom first support;

connecting the second bracket assembly to the boom second support so that the first attachment element is spaced from the first connector element;

controlling the actuator to move the slider toward the extended position until the first attachment element is aligned with the first connector element;

connecting the first attachment element to the first connector element;

disconnecting the boom extension from the first and second supports by extending the inner member from the base member;

pivoting the boom extension about the boom extension first connector element until the second attachment element is aligned with the second connector element; and connecting the second attachment element to the second connector element.

15. The method of claim 14 wherein said step of connecting the first attachment element to the first connector element comprises the step of inserting a pin through aligned openings of the first attachment element and the first connector element.

16. The method of claim 14 wherein said step of controlling the actuator to move the slider toward the extended position comprises the step of powering the actuator to move the slider to the extended position.

* * * * *